US006213935B1

(12) United States Patent
Mackin et al.

(10) Patent No.: US 6,213,935 B1
(45) Date of Patent: Apr. 10, 2001

(54) INFANT WARMING APPARATUS

(75) Inventors: Michael H. Mackin, Ellicott City; Harry E. Belsinger, Jr., Catonsville; Steven M. Falk, Baltimore, all of MD (US)

(73) Assignee: Datex-Ohmeda, Inc., Tewksbury, MA (US)

( * ) Notice: Subject to any disclaimer, the term of this patent is extended or adjusted under 35 U.S.C. 154(b) by 0 days.

(21) Appl. No.: 09/503,071

(22) Filed: Feb. 12, 2000

Related U.S. Application Data

(60) Provisional application No. 60/170,265, filed on Dec. 11, 1999.

(51) Int. Cl.[7] ..... A61G 11/00
(52) U.S. Cl. ..... 600/22
(58) Field of Search ..... 600/21–82

(56) References Cited

U.S. PATENT DOCUMENTS

| | | | | |
|---|---|---|---|---|
| 3,858,570 | | 1/1975 | Beld et al. . | |
| 4,936,824 | | 6/1990 | Koch et al. . | |
| 5,453,077 | * | 9/1995 | Donnelly et al. | 600/22 |
| 5,474,517 | | 12/1995 | Falk et al. . | |
| 5,759,149 | | 6/1998 | Goldberg et al. . | |
| 5,817,002 | | 10/1998 | Donnelly et al. . | |
| 5,817,003 | * | 10/1998 | Moll et al. | 600/22 |
| 5,971,914 | * | 10/1999 | Donnelly et al. | 600/22 |
| 6,022,310 | * | 2/2000 | Goldberg et al. | 600/22 |
| 6,063,020 | * | 5/2000 | Jones et al. | 600/22 |

* cited by examiner

*Primary Examiner*—Robert L. Nasser
(74) *Attorney, Agent, or Firm*—Roger M. Rathbun

(57) ABSTRACT

An infant care apparatus that has a canopy that can be moved vertically with respect to an infant platform on which the infant is positioned. The canopy contains a radiant heater that can be moved from a lower position enclosing the infant in an infant compartment to an upper position where the infant compartment is open and the radiant heater provides radiant energy to warm the infant. When the canopy is in its lower position there is a convective heating system that provides a forced flow of heated air to the infant compartment to heat the infant. The convective heating system includes a heater, a fan and various ducting and passageways in the infant platform that conduct the heated air to the infant compartment and receive air from that compartment for re-circulation. A control system is used to operate both the convective heating system and the radiant heater and is operable to activate the radiant heater and disable the convective heating system when the canopy is in its upper position and, conversely, to activate the convective heating system and disable the radiant heater when the canopy is in its lower position. In the preferred embodiment, when the convective heating system is disabled, the control system has a separate control of the heater and the fan of the convective heating system and can inactivate the convective heating system by shutting off the fan while retaining the heater energized at a relative low setting of heat output, thus the heater can keep the various ducting and passageway surfaces warm and improve the warm up time that the convective heating system takes to warm up the infant compartment with heated forced air when the canopy is returned to is lower position and the convective heating system again activated.

14 Claims, 4 Drawing Sheets

INFANT WARMING APPARATUS

RELATED APPLICATIONS

This application is based upon Provisional Patent application Serial No. 60/170,265 filed Dec. 11, 1999.

BACKGROUND

The present invention relates to an infant warming apparatus and, more particularly, to an apparatus for providing the combined functions of an infant incubator and an infant warmer and which includes a radiant heater contained within a housing.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus. Infant warmers normally have an overhead radiant heater that is located above the infant and which thus radiates energy in the infrared spectrum to impinge upon the infant to maintain the infant at a warm, predetermined temperature. Since the infant is otherwise totally exposed to the surroundings, there is almost unlimited access to the infant by the attending personnel to perform various procedures on that infant. At typical infant warmer is shown and described in U.S. Pat. No. 5,474,517 of Falk et al as prior art to that patent.

There are also infant incubators and which are more confined enclosures that contain the infant within an enclosed controlled atmosphere in an infant compartment and which have a convective heating system that heats air and introduces that heated air into an infant compartment to warm the infant. Such convective systems also may include some controlled humidity to introduce moisture to the heated air. Such incubators maintain the infant for long periods of time and include handholes to access the infant. Generally, there is, in addition, a larger access door that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. A typical infant incubator is shown and described in U.S. Pat. No. 4,936,824 of Koch et al.

At the present, there are also certain infant care apparatus that combine the functions of an infant warmer and an incubator and thus include a overhead radiant heater for radiant warming as well as the functions of an incubator that has a convective heating system that provides heated air to provide warmth to the infant. One such apparatus is shown and described in Donnelly et al, U.S. Pat. No. 5,453,077, where there is an upper canopy that can be raised and lowered. When the canopy is in its upper position a radiant heater is energized, however, even then, there is still a convective system that is usable that can form various heated air curtains that travel over the infant to provide heat to that infant. In Donnelly et al, the systems can be used simultaneously.

It would be advantageous to have a single system that combines a radiant heater function with an incubator function having a convective heating system but with a control system where only one of the two functions is operable at a time, that is, when the apparatus is being operated in its radiant heater mode, the convective heating system is disabled and, conversely, when the apparatus is being operated in its incubator mode utilizing the convective heating system, the radiant heater is disabled. In effect, it would be a system that would prevent the simultaneous operation of a convective system and a radiant heating system.

In addition, it would be further advantageous, at those times that the apparatus is being operated as a radiant warmer, to have some means to maintain the various air ducts and related structure warmed to improve the response time of the apparatus when that apparatus is again converted to the incubator mode, that is, the time needed to bring the infant compartment up to the desired temperature is decreased. Obviously, the response time to heat up the infant compartment using heated air is faster if the various air passages and ducting used to convey the heated air are already at an elevated temperature and the heated air from the convective heating system does not have to bring those surfaces up to some elevated temperature from ambient temperatures.

SUMMARY OF THE INVENTION

Accordingly, the present invention relates to an infant care apparatus that has an overhead canopy that can be raised and lowered by the user in converting the mode of the apparatus between a radiant heater mode where a radiant heater provides heat to the infant in an open environment and an incubator mode where a convective heating system utilizes heated air to heat the infant in an enclosed infant compartment.

In carrying out the present invention, there is a base with a vertical frame member extending upwardly from the base and a infant platform mounted to the vertical frame member above the base. The upper surface of the infant platform is a flat, planar surface that is adapted to underlie and support an infant being cared for in the use of the apparatus. Extending upwardly from the infant platform are walls of a transparent material and the vertically movable canopy is movable between a lower position where it mates with the upper edges of the walls to form therein an enclosed infant compartment and an upper position where the flat planar surface is generally open to the ambient atmosphere.

The canopy includes a radiant heater that is adapted to direct energy in the infrared range toward an infant resting upon the flat, planar surface when the canopy is in its upper position. A convective heating system is also provided to supply heated air to the infant compartment for warming the infant contained therein when the canopy is in its lower position. In the preferred embodiment, the convective heating system is contained within a heater and air moving compartment located within the infant platform underneath the flat, planar surface supporting the infant. The convective heating system includes a heater, a fan and the various ducting and passageways used to convey the air to and from the infant compartment.

A lifting system is used to raise and lower the canopy between the upper and lower positions. In addition, the infant care apparatus of the present invention includes a control system that controls the convective heating system and the radiant heater. The control system is operative to activate the radiant heater and disable the convective heating system when the canopy is in its upper position and, conversely, to activate the convective heating system and disable the radiant heater when the canopy is in its lower position.

With the canopy in the upper position, the convective heater system is disabled, however, the heater of that system may remain activated at a low level to maintain the various ducting and air passageways at an elevated temperature. Thus, although the convective heating system is disabled and the fan is off so that there is no convective heated air moving in the system, the heater itself can be maintained at a low level, not to provide heat to the infant compartment or to the infant, but simply to keep the ducting and air passageways warm.

The purpose of maintaining an elevated temperature of the ducting and air passageways is to improve the response time when the infant care apparatus is again switched to the convective heating or incubator mode. In such case, the various ducting and air passageways are already at an elevated temperature by the minimal use of the heater and do not have to be brought up to operating temperature from ambient temperature. Thus, the convective heating system can respond faster when activated since such surfaces are already heated and the system can rapidly use its heating capacity to provide the heated air to the infant compartment.

These and other features and advantages of the present invention will become more readily apparent during the following detailed description taken in conjunction with the drawings herein.

DETAILED DESCRIPTION OF THE INVENTION

Figure 1:
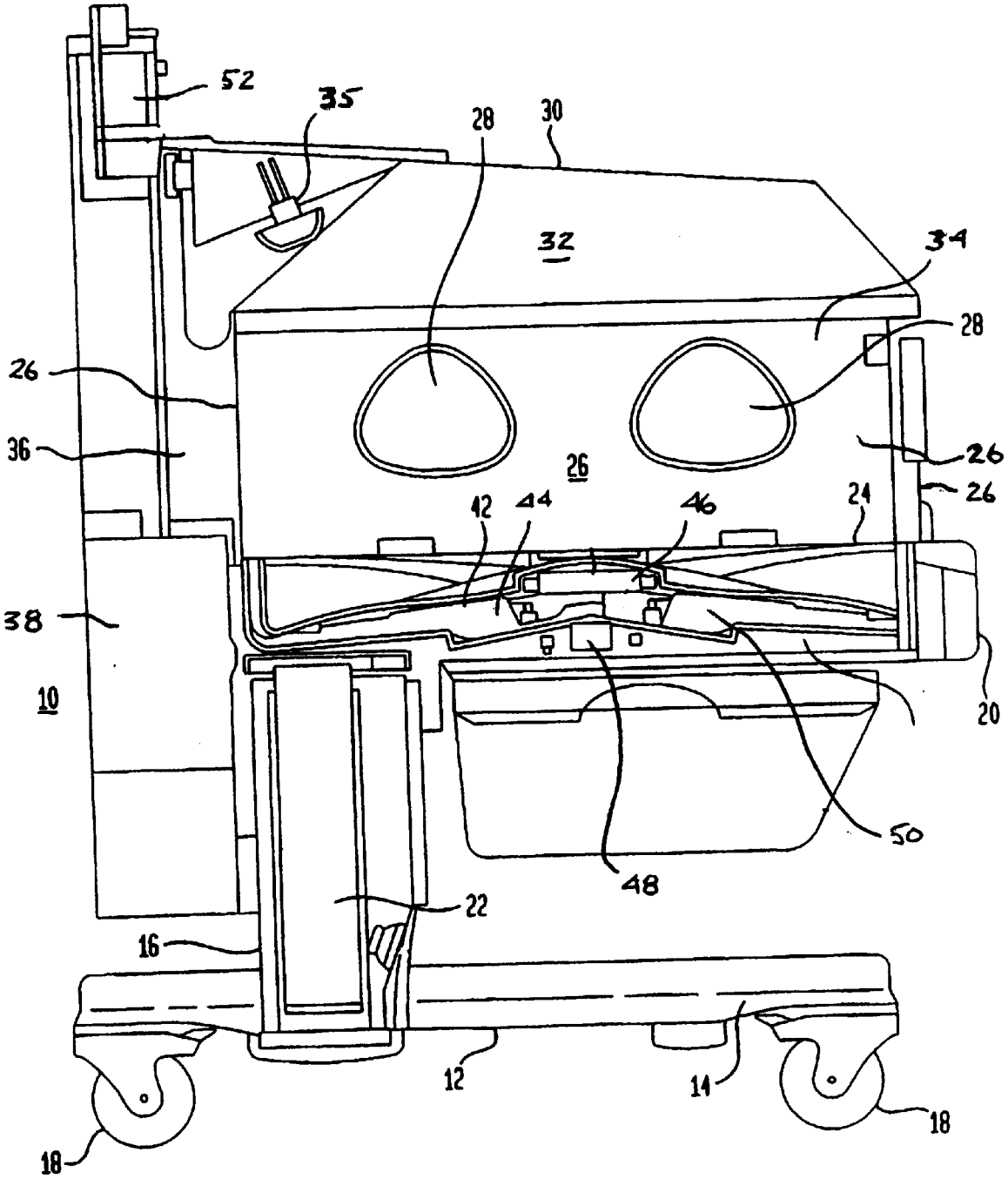
FIG. 1 is a side view of an infant care apparatus used to carry out the present invention with its canopy in the lower position.
Figure 2:
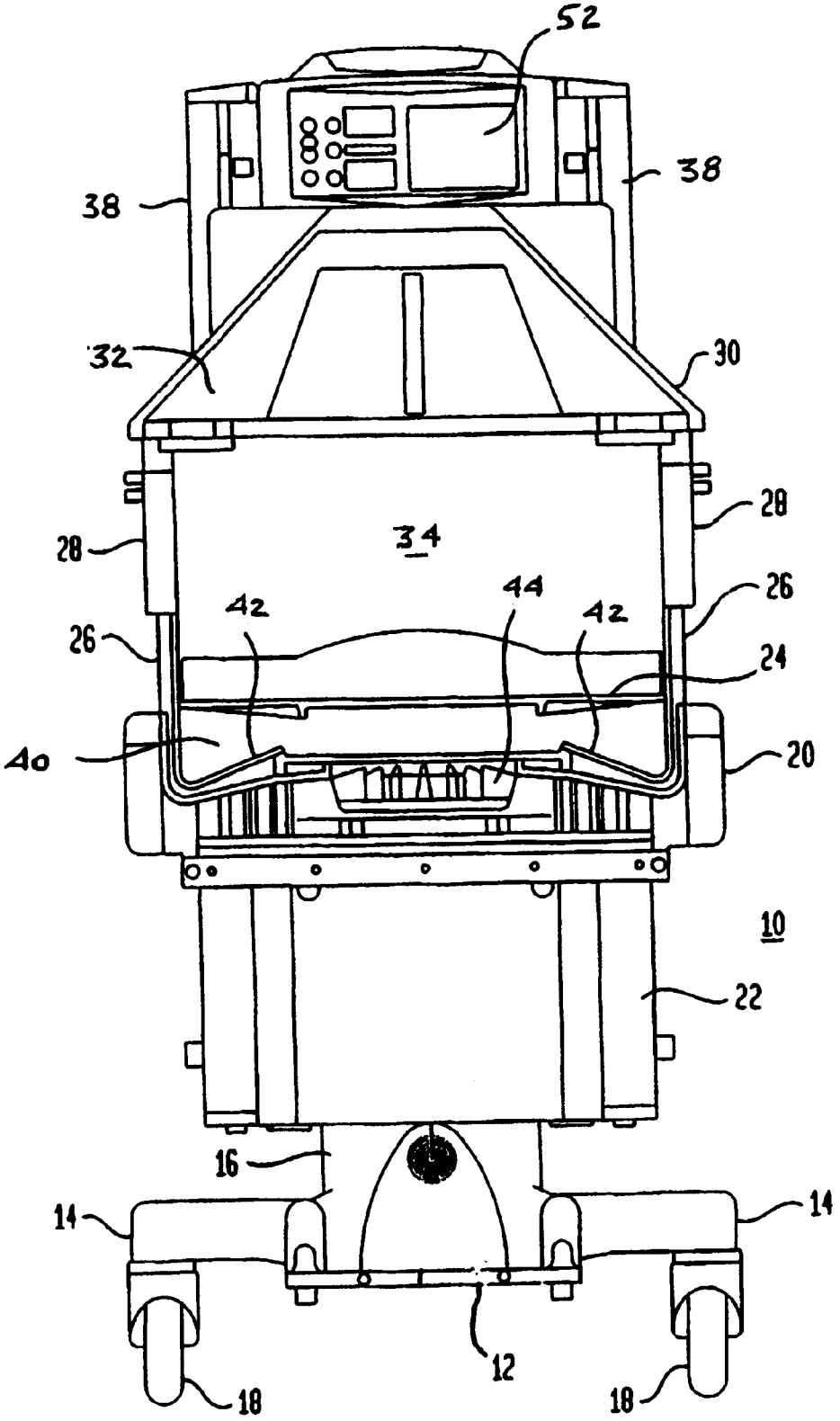
FIG. 2 is an end view of the infant care apparatus of FIG. 1.

Referring now to FIGS. 1 and 2, there are shown, a side view and an end view of an infant warming apparatus 10 constructed in accordance with the present invention in its mode of operation as an infant incubator.

Thus, in the Figs, the infant warming apparatus 10 includes a base 12 comprising a pair of U-shaped members 14 that are joined together and which provide support for a stationary vertical base member 16. Wheels 18 may also be provide for ready movement of the infant care apparatus 10.

An infant platform 20 is provided and which supports an infant in the infant care apparatus 10 and the infant platform 20 may be mounted in cantilever manner to a movable vertical member 22 in a manner such that the user can adjust the height of the infant platform 20 by raising and lowering the movable vertical base member 22 with respect to the stationary vertical base member 16 to the preferred height by the user.

The infant platform 20 includes a flat, planar surface 24 that actually underlies the infant when positioned with the infant care apparatus 10. Extending upwardly around the periphery of the infant platform 20 are a plurality of walls 26, normally of a transparent plastic material and which surround the flat planar surface 24 to enclose the infant on the surface 24. As can be seen, the walls 26 can have handholes 28 to enable the caregiver to reach the infant, however, if even more access is required to the infant, at least the side walls 26 can be dropped downwardly to open fully for complete access to the infant to carry out procedures on the infant or for introducing and removing the infant from the infant care apparatus 10.

A canopy 30 overlies the infant platform 20 and includes a transparent hood 32 that, when in the position as shown in the FIGS. 1 and 2, covers the upper peripheral edges of the walls 26 to enclose therein an infant compartment 34 that provides a controlled environment where heat and humidity can be provided and controlled to aid in the development and well being of the infant. The canopy 30 also includes a radiant heater 35 that, as will be explained, can be employed to direct radiant energy in the infrared range toward an infant resting on the flat planar surface 24 of the infant platform 20, however, that radiant heater 35 is not operational with the canopy 30 positioned as shown in FIGS. 1 and 2.

The canopy 30 can be raised and lowered vertically to cover and uncover the infant compartment 34. The raising and lowering mechanism is not part of the present invention, however a mechanism is described in detail in copending patent application 09/316,506 filed May 21, 1999 entitled Lift Mechanism For Infant Care Apparatus, the disclosure of which is incorporated herein by reference, or may be a lift system as described in the aforementioned Donnelley et al, U.S. Pat. No. 5,453,077. For purposes of the present invention, however, it is sufficient to note that the canopy 30 is affixed to a movable vertical frame member 36 that moves with respect to, and interfits with stationary vertical frame members 38 and a lifting mechanism is used to move the movable vertical frame members 34 and the canopy 30 upwardly and downwardly with respect to the stationary vertical frame members 36.

A heating and air moving compartment 40 is located within the infant platform 20 beneath the flat, planar surface 24 on which the infant is positioned and within the heating and air moving compartment 40 there is located the various ducting 42 and passageways that direct the air up to within the infant compartment 34 and to receive the air from the infant compartment 30 for re-circulation. Those ducting 42 and passageways channel the air that is used to heat the infant compartment 34 and to receive the re-circulated air from the infant compartment 34. Within the heating and air moving compartment, there is a heater 44 and a fan 46 operable by a motor 48 and which heats the air to be introduced into the infant compartment 34 to provide the warmth to the infant. As can be seen, therefore, the heater 44 is located basically in the ducting 42 and the passageways that move the air through the system and thus, as the heater heats the air by a series of fins 50, the heater also heats the ducting 40 by conduction and convection. One of such passageways is an air inlet to the infant compartment 30 shown at 43. Accordingly, as the air is heated prior to introduction into the infant compartment 34, the various ducting and passageways for that air are also being heated by the heater 44.

As other features of the infant warming apparatus 10, a control module 52 is conveniently positioned intermediate the stationary vertical frame members 38 and may include displays of various monitored parameters as well as include the various controls for operation of the functions of the infant care apparatus 10. The control module 52 may also contain the alarm functions that may be set by the user or may be established and preset by the manufacturer.

Figure 3:
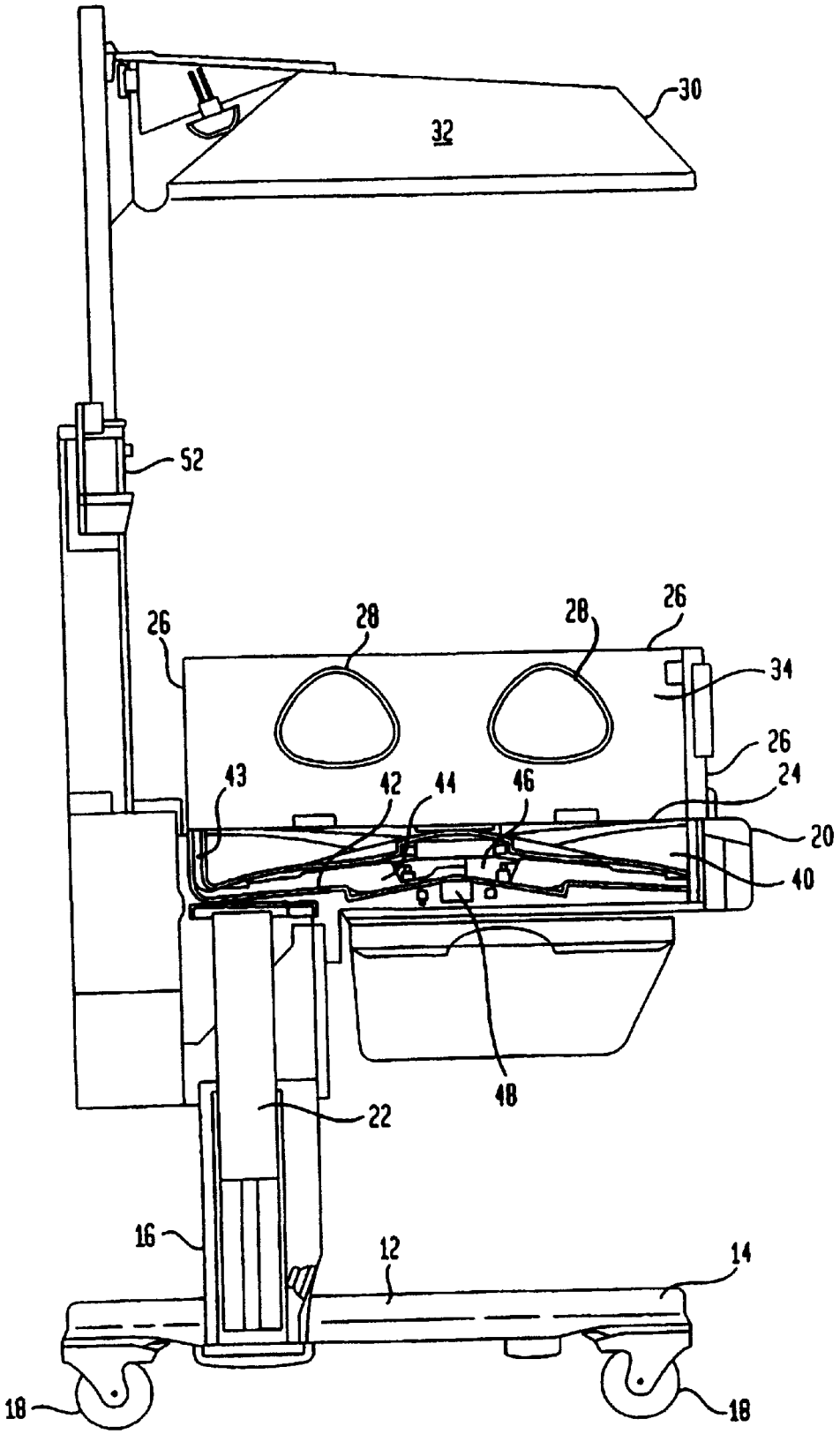
FIG. 3 is side view of the infant apparatus of FIGS. 1 and 2 with its canopy in the upper position.

Turning now to FIG. 3, there is shown a side view of the infant care apparatus constructed in accordance with the present invention and with the canopy 30 in its upper position. In this position, the apparatus acts as an infant warmer as the radiant heater 25 is energized to direct radiant energy in the infrared spectra toward an infant positioned on the flat planar surface 24 of the infant platform 20. In accordance with the control system of the present invention, when the canopy 30 is in the position shown in FIG. 3, the radiant heater 35 is activated and the convective heating system is disabled and is inoperative. Conversely, when the canopy 30 is in its lower position of FIGS. 1 and 2, the convective heating system is operative and the radiant heater 35 is disabled and thus inoperative. Accordingly, unlike the Donnelley patent, previously mentioned, in the present infant care apparatus, only one heating system is operative at any time and at no time can both systems being used to provide heat to the infant.

In the preferred embodiment, however, when the canopy 30 is in the upper position of FIGS. 1 and 2, although the convective heating system is inoperable i.e. it is no longer providing a flow of heated air, the fan 46 can be disabled and the heater 44 remain activated but at a low setting. As such, while the convective heating system is basically inoperable, the heater stays on to maintain the ducting 42 and the various passages and surfaces that channel the air when it is moving, at an elevated temperature and continues to warm those surfaces.

Thus, when the canopy 30 is again lowered and the convective heating system enabled, that ducting and internal passageway surfaces within the infant platform are already heated and the activation of the fan can operate to provide the heated air more rapidly to the infant compartment 34 rather the expend some of the heat, as well as valuable time, to heating up the various duct and passageway surfaces that carry the air to and from the infant compartment. The heater 44, at a low setting, can keep the surfaces heated by conduction and some convection to enhance the response time of the convective heating system when it is again activated.

Figure 4:
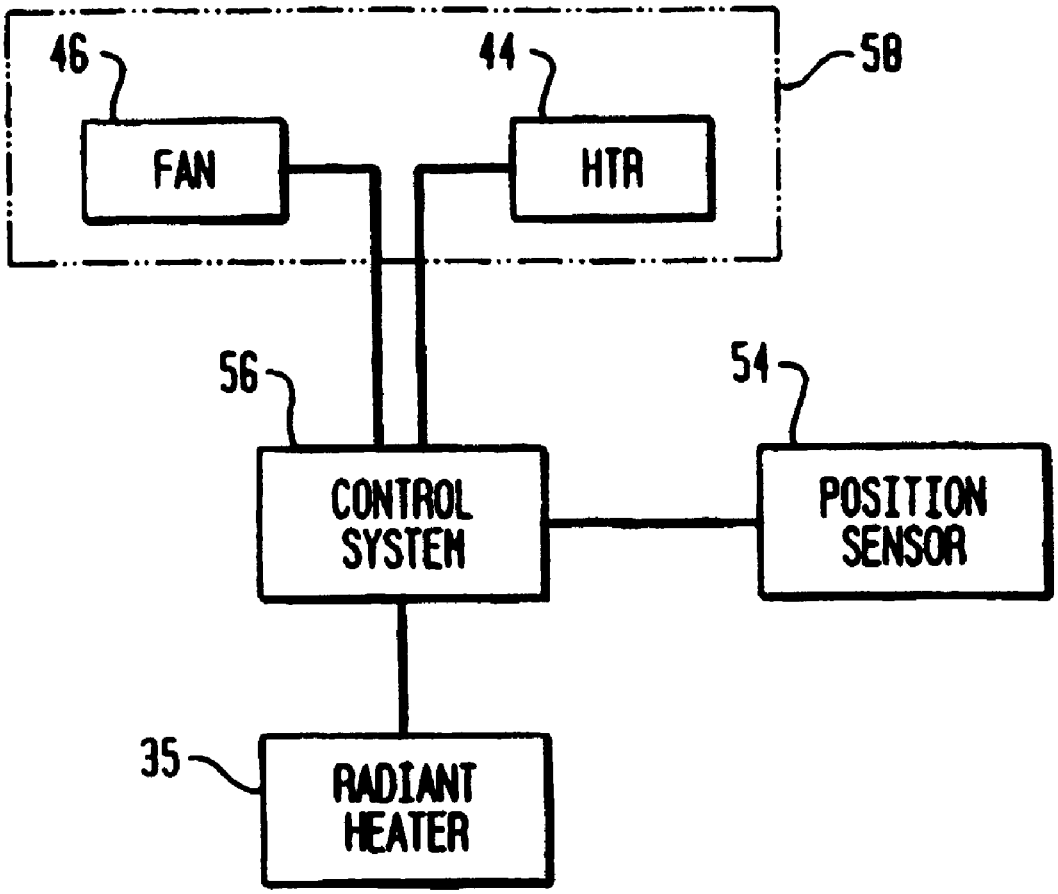
FIG. 4 is a block diagram of the control system for controlling the differing heating mean of the present invention.

Turning briefly, to FIG. 4 in conjunction with FIGS. 1–3, there is shown a block diagram of a control system for use with the present invention. In the Fig. there is a position sensor 54 that senses the position of the canopy 30 and may be any conventional means such as microswitches that send a signal to the control system 56, normally a microprocessor, to indicate whether the canopy 30 is in its lower position as shown in FIGS. 1 and 2 or in its upper position as shown in FIG. 3. Thus, depending upon the signal from the position sensor 54, the control system 56 will activate one of either the convective heating system 58 or the radiant heater 35, but not both at the same time.

When the radiant heater 35 is energized, the control system 56 will disable the convective heating system 58 and render it inoperable for providing a forced stream of heated air, and conversely, when the convective heating system is rendered operable by the control system 56, the control system 56 will disable and render inoperative the radiant heater 35, thus, at no time are the two systems operative at the same time. The respective operation of the radiant heater 35 and the convective heating system 58 is dependent upon the position of the canopy 30 and whether it is in its upper or lower position.

As seen in the preferred embodiment, when convective heating system 58 is inoperable, there is no forced heated air flow, the control system 52 can operate the heater 44 and the fan 46 independently such that the fan 46 is rendered inoperative but the heater 44 can remain activated at a low setting. Thus, when the canopy 30 is in its upper position, while the convective heating system 58 is inoperative, the heater 44 itself can remain on at that low level, as described, to maintain the various ducts and passageway surfaces at a elevated temperature to enhance the response time of the convective heating system 58 when it is again activated.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus comprising a base, an infant platform affixed to said base and having surface on which an infant is positioned, a canopy mounted to said base, said canopy being movable between a lower position wherein said canopy fits over said infant platform to form an infant compartment enclosing an infant and an upper position where said canopy is elevated with respect to said infant platform and said infant compartment is open, a mechanism for raising and lowering said canopy with respect to said infant platform to open and close said infant compartment, a convective heating system to provide heated air into said infant compartment when said canopy is in said lower position, and a radiant heater affixed to said canopy to provide radiant heat energy to said infant positioned on said surface, and a control system, said control system adapted to energize said radiant heater and disable said convective heating system when said canopy is in said upper position and to energize said convective heating system and to disable said radiant heater when said canopy is in said lower position.

2. An infant care apparatus as defined in claim 1 wherein said convective heating system includes an electric heater and a fan.

3. An infant care apparatus as defined in claim 2 wherein said control system further controls the energy to said electric heater between a high level and a low level of power.

4. An infant care apparatus as defined in claim 3 wherein said control system disables said convective heating system by shutting off said fan and setting said heater to said low level of power.

5. An infant care apparatus as defined in claim 1 wherein said infant platform includes a plurality of walls extending upwardly from said surface to form an upper peripheral edge and said canopy has a lower edge that engages said upper peripheral edge of said canopy to form said infant compartment.

6. An infant care apparatus as defined in claim 5 wherein said upper peripheral edge of said plurality of walls is generally rectangular in configuration.

7. An infant care apparatus as defined in claim 6 wherein said plurality of walls includes at least one wall that is openable for access to the infant compartment.

8. An infant care apparatus, said apparatus comprising a base, infant platform supported by said base and having a surface on which an infant is positioned, at least one vertical member extending upwardly from said base, a canopy mounted to said at least one vertical member, said canopy being movable between a lower position wherein said canopy fits over said infant platform to form an infant compartment enclosing an infant and an upper position where said canopy is elevated with respect to said infant platform and said infant compartment is open, a mechanism for raising and lowering said canopy with respect to said infant platform to open and close said infant compartment, a convective heating system to provide heated air into said infant compartment when said canopy is in said lower position, said convective heating system having a heater, a fan and ducting and passageways to direct the heated air into said infant compartment, a radiant heating affixed to said canopy to provide radiant heat energy to said infant positioned on said surface, and a control system, said control system adapted to energize said radiant heater and disable said convective heating system when said canopy is in said upper position and to energize said convective heating system and to disable said radiant heater when said canopy is in said lower position, said control system further controlling a heating means to heat said ducting and passages when said canopy is in said upper position.

9. An apparatus as defined in claim 8 wherein said control system has separate control of said fan and said heater of said convective heating system and said heating means is said heater of said convective heating system.

10. An apparatus as defined in claim 9 wherein said infant compartment comprises a plurality of transparent walls extending upwardly from said infant platform to surround said infant platform and to form an upper peripheral edge.

11. An apparatus as defined in claim 10 wherein said canopy comprises a transparent hood having a lower peripheral edge that mates with said upper peripheral edge of said plurality of transparent walls to form said infant compartment.

12. A method for controlling an infant care apparatus, said method comprising the steps of:

providing an infant platform having a planar surface for underlying an infant and having upstanding walls, providing a canopy above said infant platform, selectively moving the canopy between a lower position where the canopy covers the upstanding walls to form an infant compartment and an upper position where the infant platform is open, providing a radiant heater in the canopy and a convective heating system in the infant platform to provide heat to an infant resting on the planar surface, controlling the convective heating system and the radiant heater to activate the radiant heater and disable the convective heater when the canopy is in its upper position and to activate the convective heating system and disable the radiant heater when the canopy is in the lower position.

13. A method for controlling an infant care apparatus as defined in claim 12 wherein said step of providing a convective heating system comprises providing a convective heating system having an electric heater and a fan.

14. A method for controlling an infant care apparatus as defined in claim 13 wherein said step of controlling the convective heating system comprises disabling the convective heating system by shutting off the fan and setting the electric heater at a low level of power.

* * * * *